US009919413B2

(12) United States Patent
Smollar

(10) Patent No.: US 9,919,413 B2
(45) Date of Patent: Mar. 20, 2018

(54) CHAINSAW MOUNT DEVICE

(71) Applicant: Brian Smollar, Ironwood, MI (US)

(72) Inventor: Brian Smollar, Ironwood, MI (US)

( * ) Notice: Subject to any disclaimer, the term of this patent is extended or adjusted under 35 U.S.C. 154(b) by 0 days.

(21) Appl. No.: 15/374,166

(22) Filed: Dec. 9, 2016

(65) Prior Publication Data

US 2017/0165827 A1 Jun. 15, 2017

Related U.S. Application Data

(60) Provisional application No. 62/264,926, filed on Dec. 9, 2015.

(51) Int. Cl.
*B25H 1/00* (2006.01)
*B27B 17/00* (2006.01)

(52) U.S. Cl.
CPC ..... *B25H 1/0028* (2013.01); *B25H 1/005* (2013.01); *B27B 17/0058* (2013.01); *B27B 17/0083* (2013.01)

(58) Field of Classification Search
CPC .. B25H 1/0028; B25H 1/005; B27B 17/0083; B27B 17/0058
See application file for complete search history.

(56) References Cited

U.S. PATENT DOCUMENTS 3,695,316 A * 10/1972 Pluckhahn ..... B27B 7/00 30/381
4,210,049 A * 7/1980 Gauthier ..... B27B 17/0058 83/574
4,307,640 A * 12/1981 Michael ..... B27B 17/0058 83/574
4,350,067 A * 9/1982 Picard ..... B27B 17/0058 269/296
4,476,759 A 10/1984 Aderneck
4,538,494 A * 9/1985 Wirfelt ..... B27B 17/0058 83/574
4,606,252 A * 8/1986 Lahti ..... B27B 17/0058 83/574
4,611,521 A * 9/1986 McCardle ..... B27B 17/0058 30/382
4,640,170 A 2/1987 Bakken
(Continued)

*Primary Examiner* — Sean Michalski
(74) *Attorney, Agent, or Firm* — Global Intellectual Property Agency, LLC; Jordan Sworen

(57) ABSTRACT

A counterbalanced chainsaw mount is provided that includes a pin joint, a suspended counterweight, and a counterweight support assembly between the pin joint and counterweight. The chainsaw mount assists cutting a work piece with a chainsaw, controlling the cutting motion and counterbalancing the chainsaw to prevent kickback. The pin joint is secured to a work table or alternative support, whereby the support assembly secures at one end to the guide bar of the chain saw. Along an opposite end, the support assembly supports the counterweight. The support assembly comprises an intermediate member extending along the chainsaw guide bar and an upstanding member supporting the counterweight. The counterweight is positioned an offset distance away from the distal end of the chainsaw guide bar such that the intermediate member is biased to rotate about the pin joint and therefore elevate the proximal end of the chainsaw guide bar while attached thereto.

7 Claims, 3 Drawing Sheets

(56) References Cited

U.S. PATENT DOCUMENTS 4,726,274 A * 2/1988 Pitoni ..... B23Q 9/0014 83/574
4,757,735 A * 7/1988 Olson ..... B27B 17/0058 83/527
4,854,206 A * 8/1989 Wilfong ..... B27B 17/0083 83/574
4,949,613 A * 8/1990 Bone ..... B27B 17/0058 30/371
5,427,007 A * 6/1995 Bystrom ..... B27B 17/0083 30/371
5,511,315 A * 4/1996 Raya ..... B27B 17/0083 30/371
5,568,758 A * 10/1996 Moore ..... B27B 17/0083 83/522.18
5,784,941 A * 7/1998 Sanborn ..... B27B 17/005 83/471.2
5,884,545 A * 3/1999 Hamby, Jr. ..... B27B 1/002 144/245.2
6,038,775 A * 3/2000 Holladay ..... B23Q 9/0028 30/376
6,311,598 B1 * 11/2001 Osborne ..... B27B 17/0083 125/21
8,276,493 B2 * 10/2012 Dale ..... B23D 55/02 83/788
8,479,628 B2 7/2013 Dale
2002/0162441 A1 * 11/2002 Dumas ..... B27B 17/0058 83/796
2003/0010734 A1 * 1/2003 Bermes ..... B25H 3/006 211/70.6
2004/0244557 A1 12/2004 Peterson
2009/0014251 A1 * 1/2009 McCracken ..... A01G 23/095 187/272
2009/0133269 A1 * 5/2009 Hanaway ..... B27B 17/0083 30/383
2010/0301179 A1 * 12/2010 Brown ..... B25H 1/0021 248/124.1
2012/0111170 A1 * 5/2012 Steinfort ..... B27B 17/0058 83/796
2012/0210585 A1 * 8/2012 Gieske ..... A01G 3/086 30/296.1
2014/0047723 A1 * 2/2014 Vidale Wade ..... B27B 17/0083 30/383
2016/0288227 A1 * 10/2016 Gutierrez ..... B23D 57/023
2017/0021522 A1 * 1/2017 McCracken ..... B27B 17/0091
2017/0120354 A1 * 5/2017 Jonsson ..... B23D 57/02

* cited by examiner

CHAINSAW MOUNT DEVICE

CROSS REFERENCE TO RELATED APPLICATION

This application claims the benefit of U.S. Provisional Application No. 62/264,926 filed on Dec. 9, 2015. The above identified patent application is herein incorporated by reference in its entirety to provide continuity of disclosure.

BACKGROUND OF THE INVENTION

Field of the Invention

The present invention relates to cutting tools and tool supports. More specifically, the present invention relates to an assembly that is adapted to support a chainsaw while in operation, whereby the chain saw is pivotably supported from a workbench. The assembly supports the guide bar of the chainsaw so the chainsaw is confined to a defined cutting path and the chainsaw is biased towards a raised position.

Chainsaws are useful tools for cutting lumber. When using a chainsaw, however, there is inherent danger to the user if the chainsaw is not properly handled. In addition, chainsaws can cause "kickback" while in use, which can pose a significant risk of injury for the user. Kickback occurs when the cutting chain is pinched or when the cutting chain contacts a workpiece only along the tip of the chainsaw guide bar. The chain anchors on the work piece and the motion of the chain acts to accelerate the chain bar away from the work piece and towards the user. The kickback can be dangerous if not controlled, and controlling the chainsaw to prevent this occurrence can cause strain and fatigue over time. In addition to controlling the chainsaw while in use, handling the chainsaw with poor posture can create back pain and other associated ergonomic problems. The present invention is therefore provided to control the action of a chainsaw to improve the ergonomics for a user and to prevent unwanted kickback while in operation.

In particular, the present invention provides a chainsaw support device that is adapted to support the chainsaw while in operation, guide the chainsaw through its cutting motions, and counterbalance the weight of the chainsaw to prevent kickback. The assembly comprises a pin joint having a base that is mounted to a support surface, such as a workbench or the like. The pin joint is secured to the guide bar of a chainsaw and further connects to an intermediate member extending along the chainsaw guide bar. The intermediate member connects to an upstanding member that extends upwards and forward of the chainsaw. The upstanding member supports a counterweight positioned an offset distance away from the chainsaw to bias the chainsaw upwards and to control the motion of the guide bar during cutting operations. This supports the weight of chainsaw to improve ergonomics, and furthermore controls any unwanted kickback. The assembly can be mounted to any workbench or support surface and support any chainsaw with a guide bar.

SUMMARY OF THE INVENTION

The following summary is intended solely for the benefit of the reader and is not intended to be limiting in any way. The present invention provides a new counterbalanced chainsaw mount that can be utilized for supporting a chainsaw during a cutting motion and for preventing kickback.

It is therefore an object of the present invention to provide a new and improved chainsaw mount that has all of the advantages of the prior art and none of the disadvantages.

It is another object of the present invention to provide a counterbalanced chainsaw mount that comprises a pin joint, a base, a counterweight support assembly, and a counterweight.

Another object of the present invention is to provide a counterbalanced chainsaw mount wherein the pin joint has a center of rotation and a rotatable pin that is rotatable relative to the base. The rotatable pin has a shank that is adapted to be positioned through a chainsaw guide bar such that he base of the pin is on a first side of the chainsaw guide bar.

Another object of the present invention is to provide a counterbalanced chainsaw mount wherein the rotatable pin further secures to the counterweight support assembly. The counterweight support assembly is adapted to be positioned along a second side of the chainsaw guide bar, opposite of the pin joint mount.

Another object of the present invention is to provide a counterbalanced chainsaw mount that comprises an intermediate member and an upstanding member.

Another object of the present invention is to provide a counterbalanced chainsaw count wherein the intermediate member has a length that is adapted to extend along a length of the chainsaw guide bar and towards a proximal end thereof. Moreover, the intermediate member comprises a connection point along its length that is adapted to secure the intermediate member to the chainsaw guide bar between the proximal end of the chainsaw guide bar and the pin joint. Therefore, the intermediate member is secured along the length of the chainsaw guide bar at the pin join and at the connection point.

Another object of the present invention is to provide a counterbalanced chainsaw mount wherein the upstanding member extends from the intermediate member at a junction. The upstanding member supports a counterweight that is adapted to be positioned an offset distance away from a distal end of the chainsaw guide bar such that the intermediate member along the chainsaw guide bar is biased to rotate about the pin joint and therefore elevate the proximal end of the chainsaw guide bar.

Another object of the present invention is to provide a counterbalanced chainsaw mount wherein the junction between the upstanding member and the intermediate member is disposed along the length of the intermediate member such that the junction is adapted to be disposed between the proximal end of the chainsaw guide and the pin joint.

Another object of the present invention is to provide a counterbalanced chainsaw mount wherein the upstanding member further comprises a first member and a second member. The first member extends from the junction of the upstanding member and the intermediate member, while the second member extends at an angle relative to the first member. The first member supports the counterweight.

Another object of the present invention is to provide a counterbalanced chainsaw mount wherein the first member and second member further comprise square tube members.

Another object of the present invention is to provide a counterbalanced chainsaw mount wherein the upstanding member is adapted to extend from the intermediate member in a plane substantially parallel with the chainsaw guide bar when coupled to the chainsaw guide bar.

Another object of the present invention is to provide a counterbalanced chainsaw mount wherein the connection point further comprises a fastened connection.

Another object of the present invention is to provide a counterbalanced chainsaw mount wherein the upstanding member further comprises a clevis shackle. The clevis shackle in turn supports the counterweight.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
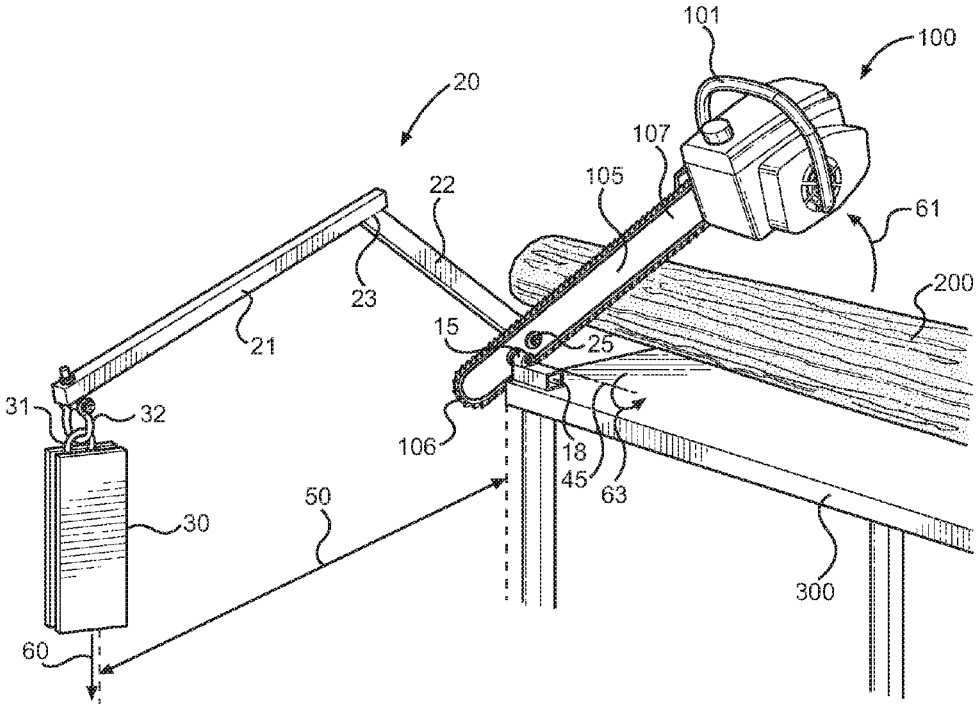
FIG. 1 shows a view of the counterbalanced chainsaw mount in its biased state, whereby the chainsaw guide bar is supported by a work surface and is biased in an elevated state.
Figure 2:
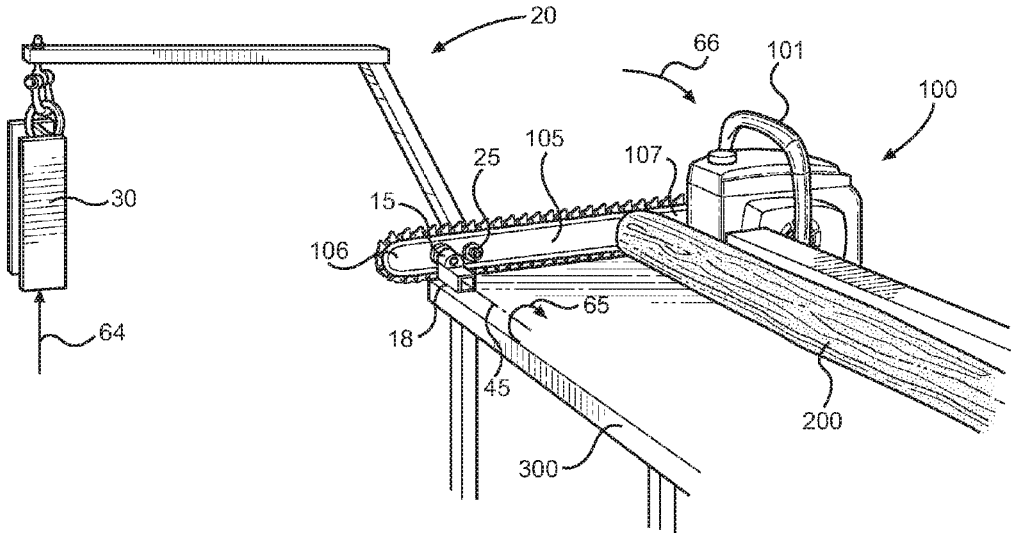
FIG. 2 shows the counterbalanced chainsaw mount n a working state, cutting a work piece.

Reference is made herein to the attached drawings, Like reference numerals are used throughout the drawings to depict like or similar elements of the counterbalanced chainsaw mount of the present invention. For the purposes of presenting a brief and clear description of the present invention, the preferred embodiment will be discussed as used for supporting a chainsaw guide bar when cutting a work piece, and preventing kickback while the chainsaw is in use. The figures are intended for representative purposes only and should not be considered to be limiting in any respect.

The counterbalanced chainsaw mount of the present invention is a tool used to assist cutting a work piece with a chainsaw. The device serves several functions, most notably supporting the chainsaw during a cutting motion and preventing kickback of the chainsaw while in use. The device therefore serves as a guide for a chainsaw and a safety device that prevents injury resulting from unexpected kickback. Referring to FIGS. 1-5, there are shown various views of the chainsaw mount, wherein the device is supporting a chainsaw 100 and is shown in different positions during the cutting motion.

In particular, the present invention comprises a pin joint 15, a counter weight support assembly 20, and a counter weight 30. The pin joint 15 comprises a base 18 that is supported on a work surface 300. The work surface 300 may be a work bench, a table, or any other suitable surface or structure upon which the pin joint 15 can be supported. In addition, the work surface 300 may be large enough to support a work piece 200 being cut by the chainsaw 100. The pin joint 15 has a center of rotation 45 and a rotatable pin 16 that is supported by the base 18 and is rotatable relative thereto. In a preferred configuration, the pin joint 15 and base 18 form a clevis, through which the rotatable pin 16 is supported. The base 18 is secured to the work surface 300 by way of one or more fasteners 19, via a welded connection 17, or an alternative attachment method. It is not desired to limit the mount to an exact fastener or connection. Rather, the base 18 of the chainsaw mount may be permanently or removably attached to the work surface 300 using appropriate attachment hardware or methods.

The shank of the rotatable pin extends from the pin joint 15 and from the base 18 in order to secure through a chainsaw guide bar 105. The chainsaw guide bar 105 is a structure that guides the chainsaw blades, whereby the guide bar 105 has a distal end 106 and a proximal end 107, The chainsaw motor and user controls 101 are located along a housing at the proximal end 107, The shank 16 of the rotatable pin 15 is adapted to be positioned through an aperture in the chainsaw guide 105 bar such that the base 18 of the pin joint 15 is on a first side of the chainsaw guide bar 105 and the shank extends through to a second side thereof.

Connecting to the shank 16 along the second side of the chain saw guide bar 107 is a counterweight support assembly 20. The counterweight support assembly 20 is a structure that supports a counter weight 30 an offset distance 50 away from the distal end 106 of the chainsaw guide bar 105. This biases the chainsaw guide bar 105 and chainsaw housing 100 into an elevated position (see FIG. 1). When a work piece 200 is to be cut, the user presses down on the handle 101 of the chainsaw to lower the chainsaw blade into the work piece 200. The counterweight 30 acts against the lowering motion 66, biasing the chainsaw upwards 61 and as the counterweight 30 is pulled downward 60 via gravity, When lowering 66 the chainsaw 100, the counterweight is lifted 64 and the chainsaw guide bar 105 rotates 65 about the pin joint central axis 45. The pin joint 15 and counterweight 30 thus constrain the motion of the chainsaw to a single, planar sweep path, while the counterweight 30 acts against any abrupt kickback that may result during the cutting operation.

Figure 5:
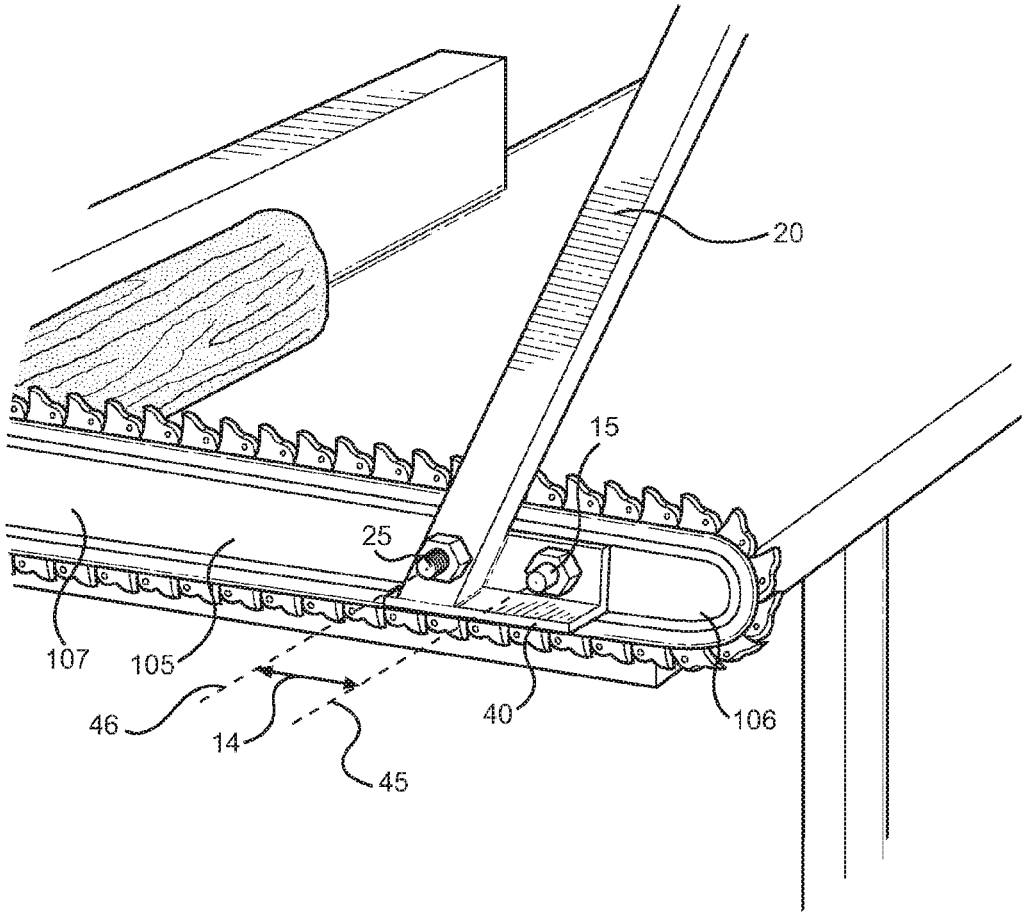
FIG. 5 shows a close-up view of the second side of the chainsaw guide bar and the intermediate member extending therealong.

The counterweight support assembly 20 is preferably comprised of an intermediate member 40 and an upright member. As shown in FIG. 5, the shank of the rotatable pin 15 secures to the intermediate member 40, whereby the intermediate member 40 extends along the second side of the chainsaw guide bar 105 and along the guide bar length. More specifically, the intermediate member 40 has a length that is adapted to be positioned along a length of the chainsaw guide bar 105 and extend towards a proximal end 107 thereof from the pin joint location 15. Therefore, the intermediate member 40 and chainsaw guide bar are substantially aligned and the intermediate member 40 extends along a portion of the chainsaw guide bar's length in an inboard direction relative to the pin joint 15.

The intermediate member 40 further connects to the guide bar 105 along its length at a connection point 25. The intermediate member 40 freely rotates about the pin joint 15 and secures to the chainsaw guide bar 105 at the connection point 25. The connection point 15 at a location along the guide bar 105 that is inboard of the pin joint (i.e. closer to the proximal end 107 than the pin joint 15). More specifically, the connection point 25 is disposed between the proximal end 107 of the chainsaw guide bar and the pin joint 15. In this manner, when the counterweight 30 acts on the support assembly 20, the connection point 25 is offset from the pin joint 15 and the counterweight 30 thus causes an upward rotation of the chainsaw about the pin joint 15. Therefore, the chainsaw guide bar has a first aperture to receive the shank 16 of the pin joint 15, and a second aperture inboard of the first aperture that is adapted to form the connection point 25. The connection point is preferably a fastened connection between the intermediate member 40 and the chainsaw guide bar 105. The fastener secures through the intermediate member 40 and the chainsaw guide bar 105 and removably secures the two together.

In one embodiment, the upright member of the counterweight support assembly 20 comprises a first length 21 and a second length 22. The first and second lengths 21, 22 form an angled upright member with an angle 23 therebetween. The first length 21 of the upstanding member supports the counterweight 30 at a position that is adapted to be an offset distance 50 away from a distal end 106 of the chainsaw guide bar 105. In this manner, the counterweight is suspended away from the guide bar and biases the intermediate member 40. This cause the intermediate member 40 and the chainsaw guide bar 105 to rotate together about the pin joint 15, and therefore elevate the chainsaw. The upstanding member and the intermediate member 40 connect at a junction along the intermediate member 40. The junction is preferably along the length of the intermediate member 40 such that the junction is adapted to be disposed between the proximal end 107 of the chainsaw guide bar 105 and the pin joint 15. Thus, the counterweight 30 draws the intermediate member 40 upwards at the junction, which is offset from the pin joint 15.

Figure 3:
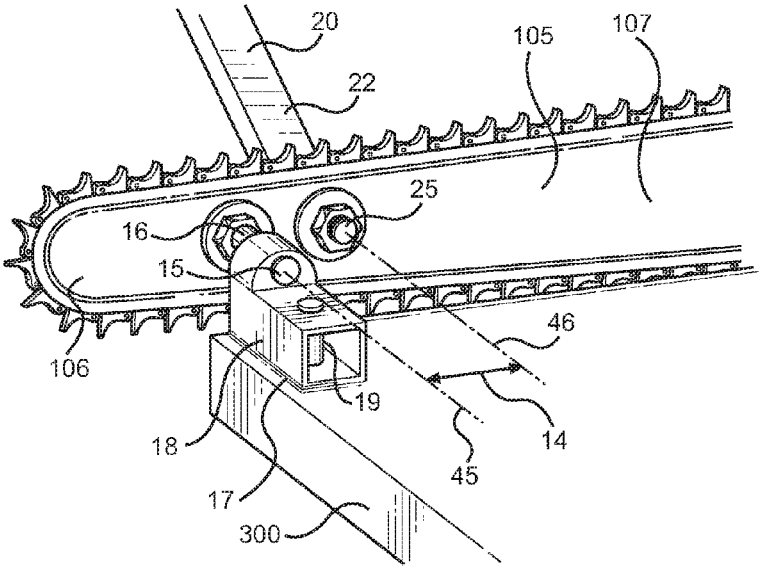
FIG. 3 shows a close-up view of the pin joint and connection point along the chainsaw guide bar.
Figure 4:
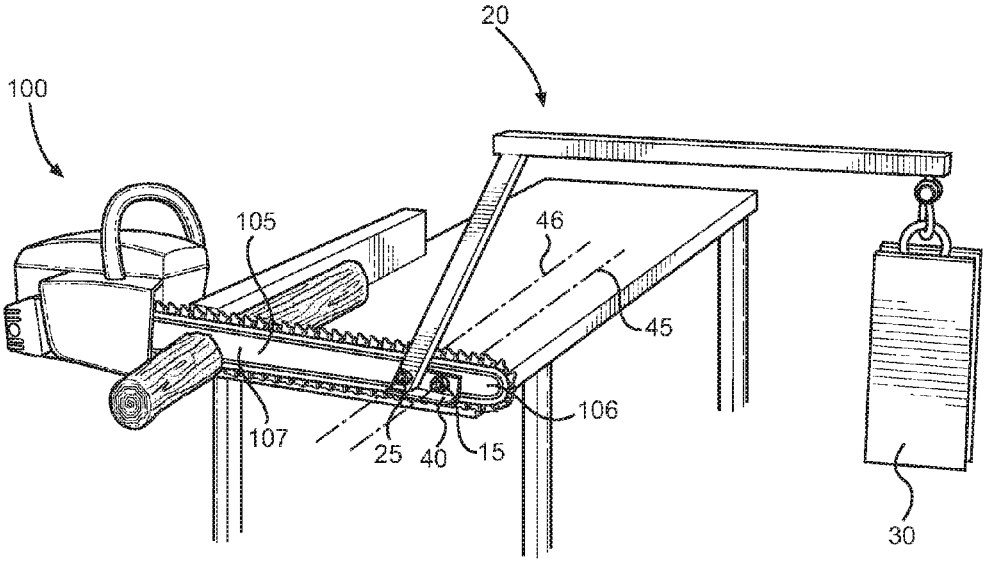
FIG. 4 shows a view of the second side of the chainsaw guide bar and the intermediate member extending therealong.

Several embodiments of the present invention are contemplated, including materials and design. The counterweight 30 is offset 50 from the distal end 106 of the guide bar 105, while the upright member of counterweight support assembly 20 is offset 14 from the pin joint 15 along the intermediate member 40. As shown in FIG. 3, the offset 14 between the connection point central axis 46 and the pin joint central axis 45 provides a moment arm about the pin joint 15, about which the counterweight 30 bias the chainsaw guide bar 105 upwards. This assists controlling the chainsaw, and prevents kickback.

Embodiments of the device may vary. Contemplated embodiments include an intermediate member and upright member comprised of square tube material. Additionally, the counterweight support assembly 20, and specifically the upstanding member 20, may extend from the intermediate member 40 only in substantially the same plane as the chainsaw guide bar 105 when coupled thereto. Alternatively, the counterweight support assembly 20 and/or upstanding member 20 may extend in parallel to the plane of the chainsaw guide bar 105. The counterweight 30 is suspended outboard and an offset distance 50 from the chainsaw guide bar 105 and the pin joint 15 in order to bias the chainsaw upwards 61 when not engaged in a cutting operation. To assist this, the counterweight 30 may also be supported by a clevis shackle 32 and hoop 31, thereby allowing the counterweight 30 to remain substantially vertical through its sweep path. However, additional embodiments are contemplated wherein the counterweight is directly affixed to the counterweight support assembly.

Overall, it is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A counterbalanced chainsaw mount, comprising:

a pin joint having a base, the pin joint having a center of rotation and a rotatable pin that is rotatable relative to the base;

the rotatable pin further comprising a shank adapted to be positioned through a chainsaw guide bar such that the base is on a first side of the chainsaw guide bar;

the rotatable pin securing to an intermediate member that is adapted to be along a second side of the chainsaw guide bar;

the intermediate member having a length that is adapted to extend along a length of the chainsaw guide bar and towards a proximal end thereof;

the intermediate member further comprising a connection point along its length that is adapted to secure the intermediate member to the chainsaw guide bar between the proximal end of the chainsaw guide bar and the pin joint;

an upstanding member extending from the intermediate member at a junction;

wherein the upstanding member supports a counterweight adapted to be positioned an offset distance away from a distal end of the chainsaw guide bar such that the intermediate member is biased to rotate about the pin joint and therefore be adapted to elevate the proximal end of the chainsaw guide bar.

2. The counterbalanced chainsaw mount of claim 1, wherein:

the junction between the upstanding member and the intermediate member is disposed along the length of the intermediate member such that the junction is adapted to be disposed between the proximal end of the chainsaw guide bar and the pin joint.

3. The counterbalanced chainsaw mount of claim 1, wherein:

the upstanding member comprises a first member and a second member;

the first member extending from the junction of he upstanding member and the intermediate member;

the second member extending at an angle relative to the first member;

the first member supporting the counterweight.

4. The counterbalanced chainsaw mount of claim 3, wherein the first member and second member further comprise square tube members.

5. The counterbalanced chainsaw mount of claim 1, wherein:

the upstanding member is adapted to extend from the intermediate member in a plane substantially parallel with the chainsaw guide bar when coupled to the chainsaw guide bar.

6. The counterbalanced chainsaw mount of claim 1 wherein the connection point further comprises a fastened connection.

7. The counterbalanced chainsaw mount of claim 1, wherein:

the upstanding member further comprises a clevis shackle;

the clevis shackle supporting the counterweight.

* * * * *